US008478171B2

(12) United States Patent
Sasaki

(10) Patent No.: US 8,478,171 B2
(45) Date of Patent: Jul. 2, 2013

(54) TONER BOTTLE AND IMAGE FORMATION APPARATUS PROVIDED WITH THE SAME

(75) Inventor: Tatsuyuki Sasaki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 273 days.

(21) Appl. No.: 12/881,787

(22) Filed: Sep. 14, 2010

(65) Prior Publication Data

US 2011/0064479 A1 Mar. 17, 2011

(30) Foreign Application Priority Data

Sep. 17, 2009 (JP) ..... 2009-215327

(51) Int. Cl.
*G03G 15/08* (2006.01)

(52) U.S. Cl.
USPC ..... 399/262; 399/120; 399/258; 399/260

(58) Field of Classification Search
USPC ..... 399/120, 258, 260
See application file for complete search history.

(56) References Cited

U.S. PATENT DOCUMENTS

| | | | | |
|---|---|---|---|---|
| 6,259,877 | B1 * | 7/2001 | Taniyama et al. | 399/262 |
| 6,298,208 | B1 * | 10/2001 | Kawamura et al. | 399/262 |
| 6,671,482 | B2 * | 12/2003 | Dilanni et al. | 399/262 |
| 6,785,497 | B1 * | 8/2004 | Hasebe | 399/260 |
| 7,486,915 | B2 * | 2/2009 | Koyama et al. | 399/258 |
| 7,747,194 | B2 * | 6/2010 | Takuwa | 399/120 |
| 7,962,064 | B2 * | 6/2011 | Asai | 399/120 |
| 2007/0140707 | A1 * | 6/2007 | Kaiho | 399/12 |
| 2008/0181674 | A1 * | 7/2008 | Kaiho | 399/262 |
| 2008/0240771 | A1 * | 10/2008 | Kurita et al. | 399/106 |
| 2009/0003886 | A1 * | 1/2009 | Takuwa | 399/262 |
| 2009/0097877 | A1 * | 4/2009 | Kaiho | 399/106 |

FOREIGN PATENT DOCUMENTS

| | | |
|---|---|---|
| JP | 6-102758 A | 4/1994 |
| JP | 6-186844 A | 7/1994 |
| JP | 07-199657 | 8/1995 |
| JP | 10-207207 | 8/1998 |
| JP | 2008-052033 A | 3/2008 |

OTHER PUBLICATIONS

Office Action dated Jul. 26, 2011, issued in the corresponding Japanese Patent Application No. 2009-215327, and an English Translation thereof.

* cited by examiner

*Primary Examiner* — David Gray
*Assistant Examiner* — Francis Gray
(74) *Attorney, Agent, or Firm* — Buchanan Ingersoll & Rooney PC

(57) ABSTRACT

A toner bottle includes a toner accommodating container, an inner lid including an inner discharge port, a measurement shutter member movable between an accumulation position where toner is accumulated in space formed between the measurement shutter member and the inner discharge port, and a discharge position where the toner accumulated in the space is discharged, an inner discharge port sealing member, and an outer lid for rotatably supporting the toner accommodating container in a state that the outer lid surrounds the inner discharge port. The outer lid has a shutter opening and closing inner peripheral surface where a restraint portion for restraining the measurement shutter member at the accumulation position, and a non-restraint portion capable of moving the measurement shutter member to the discharge position so that an outer surface of the measurement shutter member is abutted with the non-restraint portion are arranged in the circumferential direction.

10 Claims, 15 Drawing Sheets

TONER BOTTLE AND IMAGE FORMATION APPARATUS PROVIDED WITH THE SAME

This application is based on Japanese Patent Application No. 2009-215327 filed on Sep. 17, 2009, the contents of which are incorporated herein by reference.

BACKGROUND OF THE INVENTION

The present invention relates to a toner bottle, and an image formation apparatus provided with the same.

Conventionally, there is a known image formation apparatus in which a toner cartridge such as a toner bottle is detachably installed in a main body of the image formation apparatus, and toner is supplied from the toner bottle to a developing device of a process cartridge.

In an image formation apparatus shown in Japanese Unexamined Patent Publication No. 2008-52033, in order to discharge toner from a toner bottle so as to supply a fixed amount of the toner to a developing device of a process cartridge, there is a need for providing a sub-hopper between the toner bottle and the process cartridge. However, with such a structure, there are problems that size of the apparatus is increased, and cost is also increased.

In a toner supply apparatus shown in Japanese Unexamined Patent Publication No. 6-186844, a fixed amount supply mechanism is provided on the side of a main body of an image formation apparatus, and a discharge port of a toner bottle is connected to the fixed amount supply mechanism, so that the toner bottle is installed in the main body of the image formation apparatus. The toner bottle is provided with a spiral shape stirring and feeding member inside, and the discharge port is opened. Thus, when the toner bottle is removed from the toner supply apparatus with the discharge port directed downward, there is a problem that the toner is spilled out. Therefore, there is a need for devising ways to attach and detach the toner bottle in a state that the discharge port of the toner bottle is directed upward on the side of the main body of the image formation apparatus, and size of the mechanism is increased.

In a developer accommodating container shown in Japanese Unexamined Patent Publication No. 6-102758, an opened portion is formed in an outer peripheral portion on the side of an end of a cylinder body in which toner is accommodated, a measurement chamber of a holder provided with the measurement chamber having fixed volume is arranged on the outer side in the radial direction of the cylinder body of the opened portion, and the holder is attached so as to cover the side of the end of the cylinder body. The measurement chamber has an opening on the rear side in the rotation direction of the cylinder body, and a valve body is provided in the opening. In addition to the opening part of the cylinder body, the valve body further protrudes to the outer side in the shaft direction of the cylinder body from an end surface of the cylinder body. The valve body is periodically opened in accordance with rotation of the cylinder body by an engagement portion to be engaged with a protruding part of the valve body provided in the developer accommodating container.

SUMMARY OF THE INVENTION

A toner bottle of the present invention includes a cylindrical toner accommodating container having an opened portion on the one side and a closed portion on the other side for accommodating toner inside, an inner lid attached to the toner accommodating container so as to close the opened portion, the inner lid including an inner discharge port on an outer peripheral surface, a measurement shutter member provided so as to cover the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged, and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion.

An image formation apparatus of the present invention includes a toner bottle having a cylindrical toner accommodating container having an opened portion on the one side and a closed portion on the other side for accommodating toner inside, an inner lid attached to the toner accommodating container so as to close the opened portion, the inner lid including an inner discharge port on an outer peripheral surface, a measurement shutter member provided so as to cover the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged, and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion.

DETAILED DESCRIPTION OF THE PREFERRED EMBODIMENTS

Hereinafter, an embodiment of the present invention will be described based on the drawings.

Figure 1:
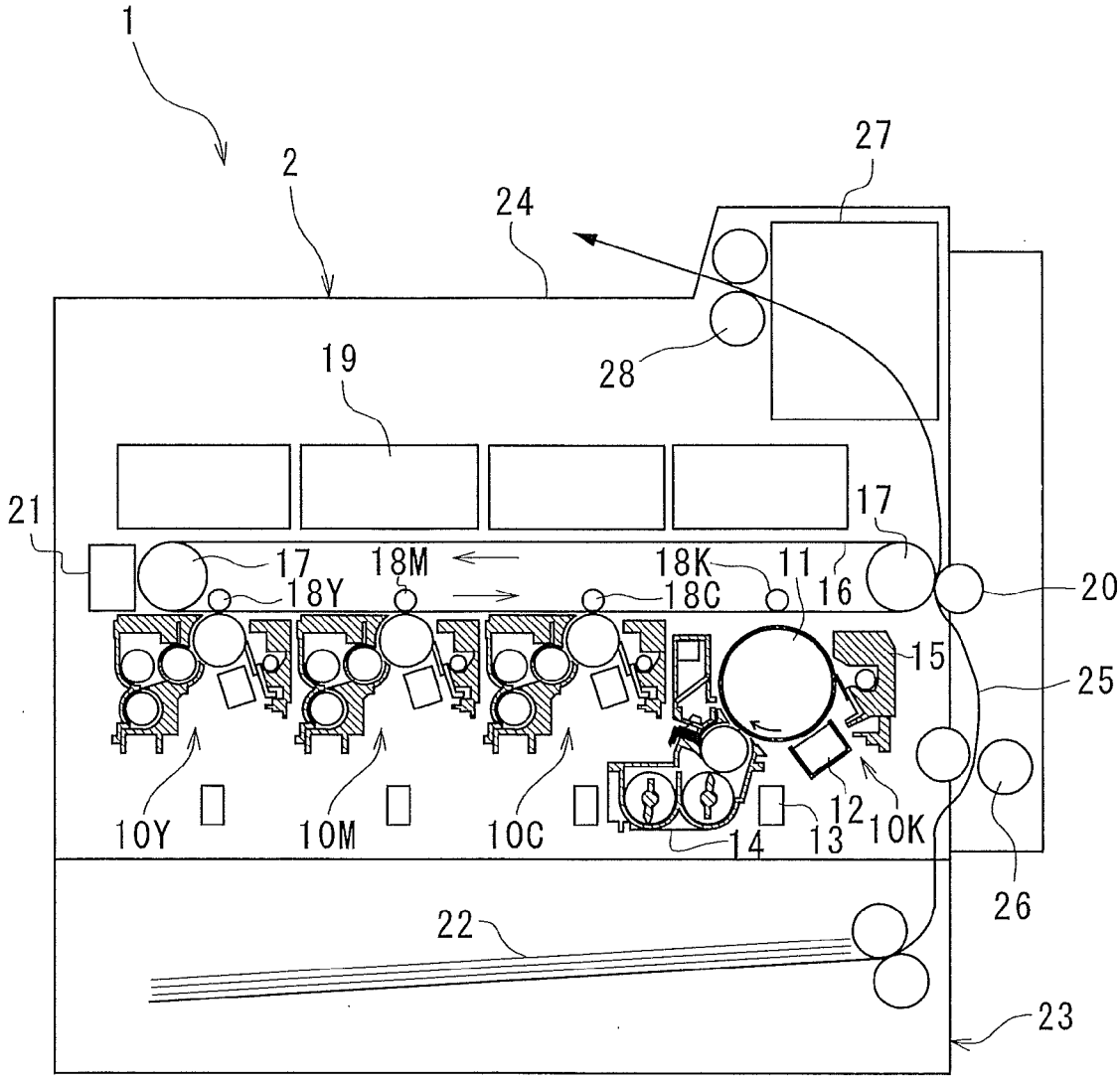
FIG. 1 is a schematic view showing an image formation apparatus.

FIG. 1 is a schematic view related to a general tandem type image formation apparatus 1 of a full color electronic photograph system to which the present invention is applied. It should be noted that this image formation apparatus 1 may be a monochrome/color and analogue/digital type of any of a PPC, a printer, a FAX, and a combined machine.

In an main body 2 of the image formation apparatus 1, four process cartridges 10Y, 10M, 10C, 10K of yellow (Y), magenta (M), cyan (C), and black (K) are arranged.

Figure 2:
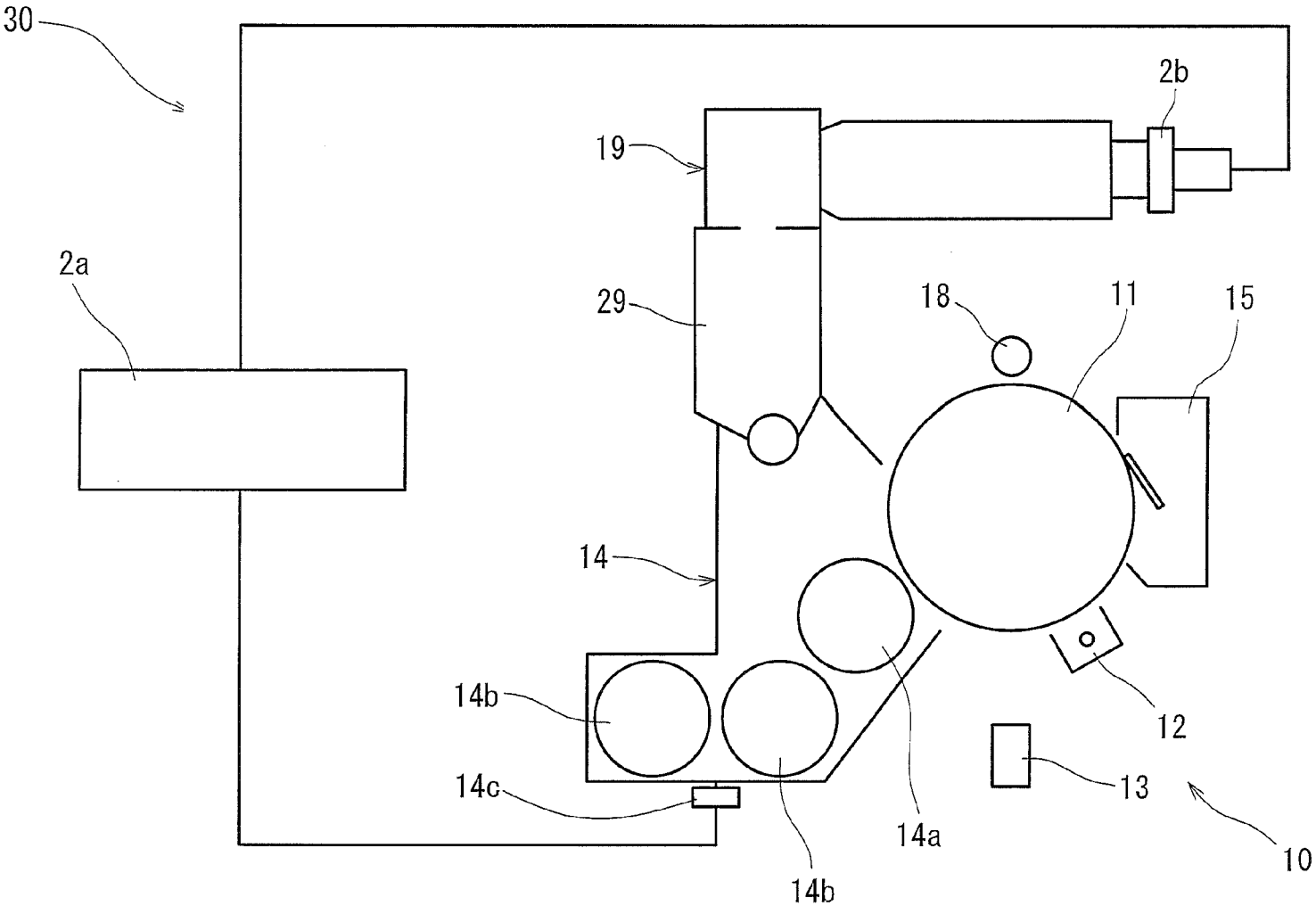
FIG. 2 is a schematic view showing an internal configuration of an image recording portion in the image formation apparatus.

In each of the process cartridges 10Y, 10M, 10C, 10K, a charger 12, a developing device 14, and a cleaning device 15 are provided around a photoconductor drum 11. As shown in FIG. 2, the developing device 14 is provided with a developing roller 14*a*, stirring and feeding members 14*b*, and a TCR (Toner Carrier Ratio) sensor 14*c* that detects toner concentration. A toner feed device 29 is provided on the upper side of the developing device 14. The developing device 14 and the toner feed device 29 may be integrated with each other or separatable from each other. In the main body 2 of the image formation apparatus, image exposure devices 13 are respectively provided on the lower side of the process cartridges 10Y, 10M, 10C, 10K. On the upper side of the process cartridges 10Y, 10M, 10C, 10K, an intermediate transfer belt 16 is stretched round a pair of rollers 17, and circulated and moved in the arrow direction by drive means (not shown). On the inner side of the intermediate transfer belt 16, primary transfer devices 18 are provided so as to face the photoconductor drums 11 of the process cartridges 10Y, 10M, 10C, 10K. On the outer side of the intermediate transfer belt 16, a secondary transfer device 20 facing one of the rollers 17 and a transfer belt cleaning device 21 facing the other roller 17 are provided. Further, on the lower side of the process cartridges 10Y, 10M, 10C, 10K, a paper supply cassette 23 accommodating recording paper (recording medium) 22 is provided. A recording medium feed passage 25 is formed from the paper supply cassette 23 to a paper discharge tray 24 on an upper surface via the secondary transfer device 20. Feed rollers 26 are provided between the paper supply cassette 23 and the secondary transfer device 20 in the recording medium feed passage 25. A fixing device 27 is provided between the secondary transfer device 20 and the paper discharge tray 24 in the recording medium feed passage 25, and paper discharge rollers 28 are provided on the side of the fixing device 27 relative to the paper discharge tray 24. A control unit 2*a* is provided in the main body 2 of the image formation apparatus. On the upper side of the process cartridges 10Y, 10M, 10C, 10K, toner bottles 19 are provided. The toner bottles 19 will be described later in detail. On the near side of the process cartridges 10Y, 10M, 10C, 10K relative to a paper plane of the figure, a waste powder collecting device (not shown) is attached.

Each of the process cartridges 10Y, 10M, 10C, 10K, the image exposure device 13, the primary transfer device 18, the toner bottle 19, the control unit 2*a* in the main body 2 of the image formation apparatus, and the toner feed device 29 serve as an image recording portion 30.

In each of the process cartridges 10Y, 10M, 100, 10K, a surface of the photoconductor drum 11 is uniformly charged at desired potential by the charger 12, and the surface of the photoconductor drum 11 is exposed to light by the image exposure device 13 based on a command from the control unit 2*a* for processing image data so as to form an electrostatic latent image. Toner is supplied from the developing device 14 to the photoconductor drum 11 in which the electrostatic latent image is formed, so that the electrostatic latent image is developed and formed as a toner image on the photoconductor drum 11. The developed toner images are successively transferred to the intermediate transfer belt 16 by the primary transfer devices 18Y, 18M, 18C, 18K. The four color toner images overlying one another are collectively transferred by the secondary transfer device 20 from the intermediate transfer belt 16 to the recording paper 22 fed by the feed rollers 26 from the paper supply cassette 23. After the toner images transferred to the recording paper 22 are fixed by the fixing device 27, the recording paper 22 is discharged by the paper discharge rollers 28 to the paper discharge tray 24.

The toner remaining on the photoconductor drums 11Y, 11M, 11C, 11K after the transfer by the primary transfer devices 18 is scraped by the cleaning devices 15Y, 15M, 15C, 15K including cleaning blades. The toner remaining on the intermediate transfer belt 16 after the transfer by the secondary transfer device 20 is scraped by the transfer belt cleaning device 21 including a cleaning blade. The toner scraped by the cleaning devices 15Y, 15M, 15C, 15K and the transfer belt cleaning device 21 is respectively collected by the waste powder collecting device (not shown).

Figure 3:
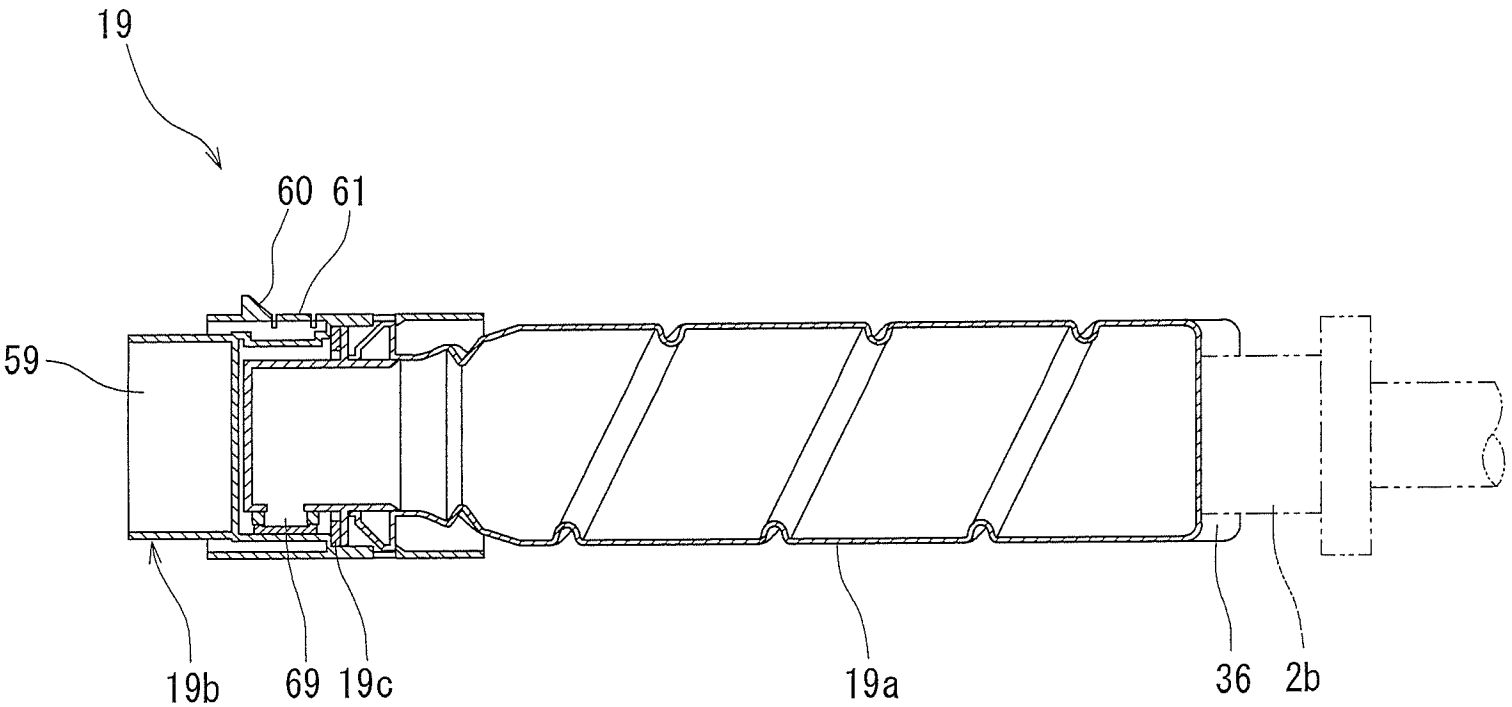
FIG. 3 is a sectional view showing a toner bottle according to the present invention.
Figure 4:
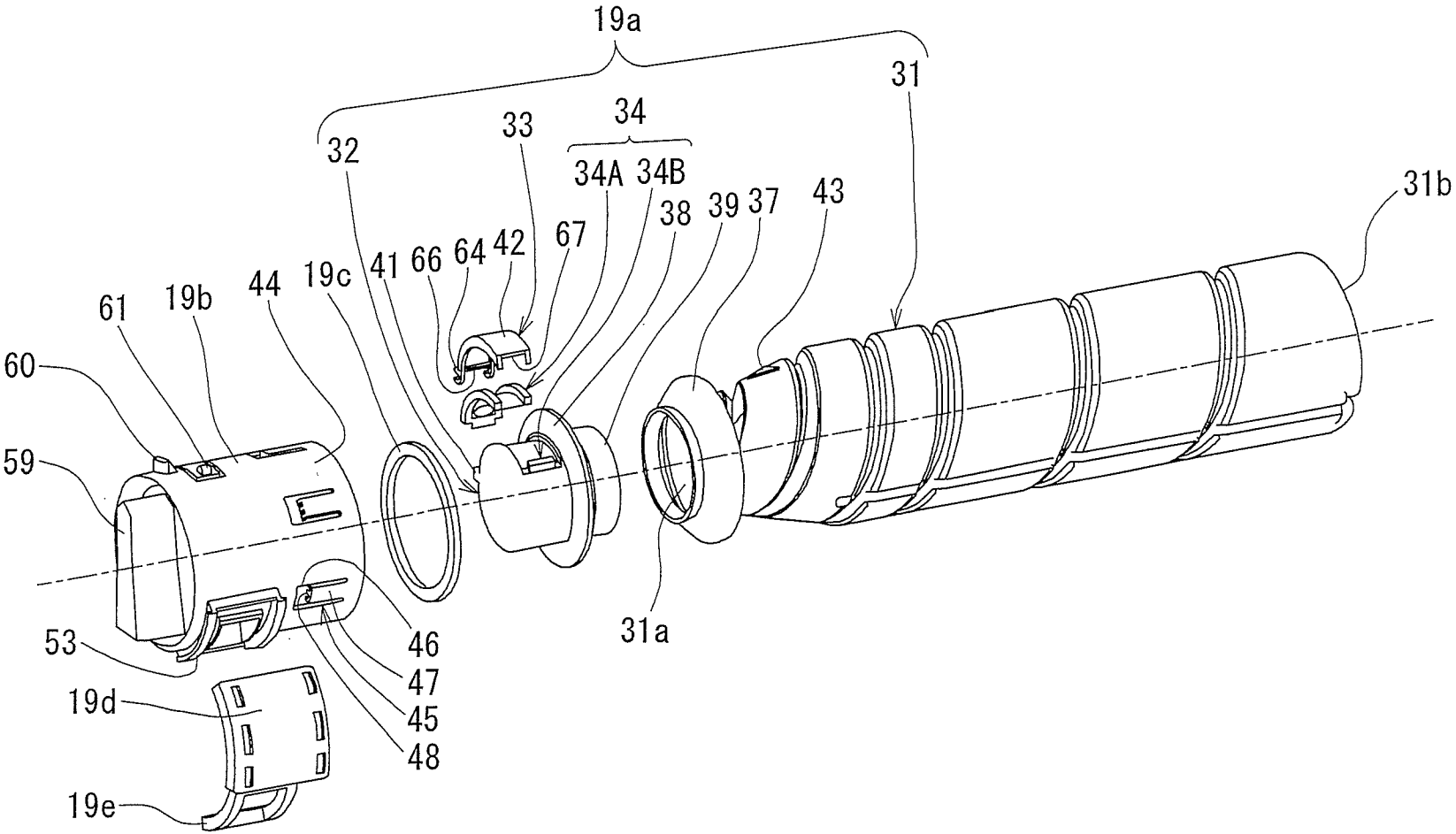
FIG. 4 is an exploded perspective view showing the toner bottle according to the present invention.
Figure 5:
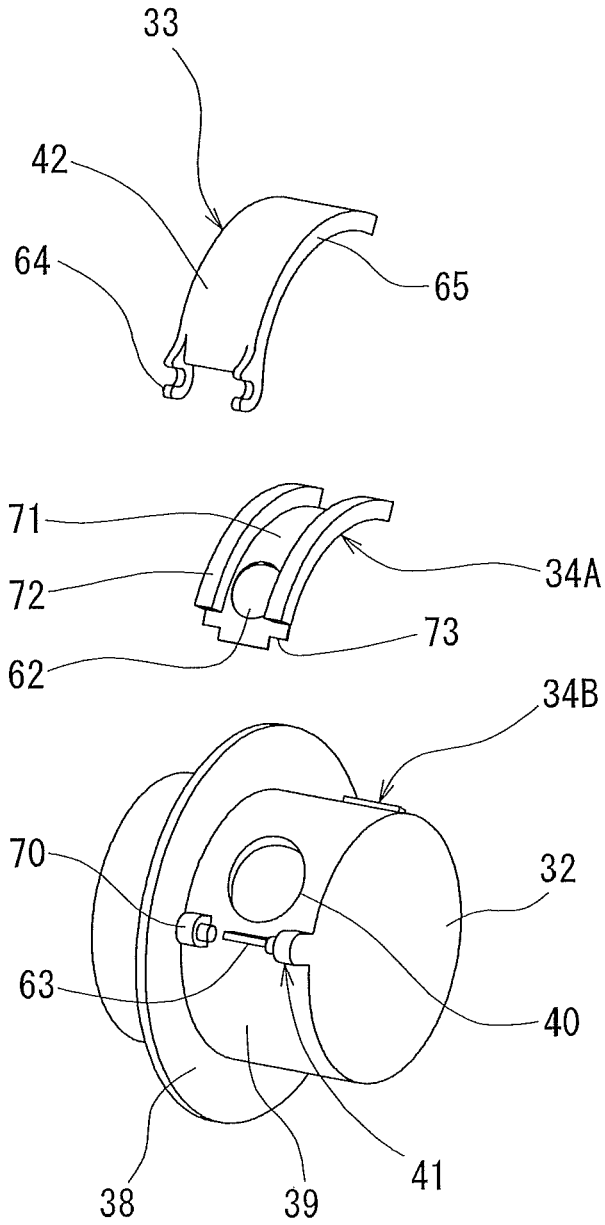
FIG. 5 is a perspective view showing a measurement shutter member, an inner discharge port sealing member, and an inner lid.

Next, the toner bottles 19 will be described in detail. As shown in FIGS. 3 to 5, each of the toner bottles 19 is provided with a toner bottle main body 19*a*, an outer lid 19*b*, a shaft direction sealing member 19*c*, an outer shutter member 19*d*, and an outer discharge port sealing member 19*e*.

The toner bottle main body 19*a* is provided with a toner accommodating container 31, an inner lid 32, a measurement shutter member 33, and inner discharge port sealing members 34.

The toner accommodating container 31 is formed into a cylindrical shape having an opened portion 31*a* on the one side and a closed portion 31*b* on the other side for accommodating the toner. The toner accommodating container 31 is provided with a spiral shape toner feed portion 35 inside. On an outer surface of the closed portion 31*b* orthogonal to the shaft direction of the toner accommodating container 31, an engagement portion 36 to be engaged with a drive unit 2*b* having a claw shape end in the main body 2 of the image formation apparatus. The toner accommodating container 31 is rotated by drive force obtained from the drive unit 2*b* in the main body 2 of the image formation apparatus via the engagement portion 36, so that the toner is fed by the toner feed portion 35 to the side of the opened portion 31*a*. In the toner accommodating container 31, a rotation support engagement portion 37 rotatably supported by the outer lid 19*b* is formed on the side of the opened portion 31*a* over the entire range in the circumferential direction so as to protrude in the radial direction. In the toner accommodating container 31, as shown in FIG. 15, a measurement shutter position display portion 43 is provided at a position to be visually recognized from an exterior in order to recognize a position of the measurement shutter member 33 of the toner bottle main body 19*a*. In the present embodiment, the measurement shutter position display portion 43 is a triangle adhesive member arranged so that one of triangle tips is directed in the shaft direction. The measurement shutter position display portion 43 is not limited to the adhesive member but may be other members.

The inner lid 32 is formed into a cylindrical shape having an opened portion 32*a* on the one side and a closed portion 32*b* on the other side. A flange portion 38 is provided on an outer peripheral surface 39 between the opened portion 32*a* and the closed portion 32*b*. An inner discharge port 40 communicating with the opened portion 32*a* is provided on the outer peripheral surface 39 of the inner lid 32 between the flange portion 38 and the closed portion 32*b*. The inner discharge port 40 is desirably not less than ϕ6 and not more than ϕ11. A fixing portion 41 for fixing and positioning a fixed shaft in the direction orthogonal to the rotation direction is provided on the front side of the inner discharge port 40 in the forward direction in rotation of the toner bottle main body 19*a*. In the fixing portion 41, between bosses 70, 70 provided on the outer side in the radial direction on the outer peripheral surface 39 of the inner lid 32 and on the front side in the rotation direction, the bosses arranged in the direction orthogonal to the rotation direction, a shaft 63 extending from one of the bosses 70 to the other boss 70 is formed so as to produce a gap between an end of the shaft 63 and the other boss 70. The opened portion 32*a* of the inner lid 32 is fitted into the inner side of the rotation support engagement portion 37 of the toner accommodating container 31, and the flange portion 38 of the inner lid 32 is abutted with an end of the rotation support engagement portion 37 of the toner accommodating container 31. That is, the inner lid 32 is attached to the toner accommodating container 31 so as to have a sealing property. In the present embodiment, the inner lid 32 is integrally fixed to the toner accommodating container 31 by press fitting of applying force in the direction in which the opened portion 31*a* of the toner accommodating container 31 is pushed and spread out. One of the triangle tips of the measurement shutter position display portion 43 and a part which is the most distant from a rotation shaft in the radial direction on an outer surface 42 of the measurement shutter member 33 described later are respectively positioned in the same direction from a center of the rotation shaft on the outer side in the radial direction.

The measurement shutter member 33 has the outer surface 42 formed into an arc shape in a section orthogonal to the rotation shaft. Thickness of the outer surface 42 is 1.5 mm. On both side edges of arc parts of the outer surface 42, thin plate shape arc side surface portions 65 extending inward in the radial direction are provided. On both ends of both the arc side surface portions 65, 65 on the front side in the forward direction in the rotation, a front side sealing portion 66 connecting both the ends and extending inward in the radial direction from the outer surface 42 is provided. The front side sealing portion 66 is abutted with the outer peripheral surface 39 of the inner lid 32 at an accumulation position described later. Ends of both the arc side surface portions 65, 65 on the rear side in the forward direction in the rotation and the outer surface 42 form a rear side opened portion 67. In the present embodiment, the arc side surface portions 65 and the part of the rear side opened portion 67 of the outer surface 42 serve as an outer peripheral edge 68. Bottom surfaces of both the arc side surface portions 65, 65 are to be abutted with upper surfaces of an inner discharge port sealing member 34A at the accumulation position. In the rear side opened portion 67, the outer surface 42 is to be abutted with an inner discharge port sealing member 34B. In a state that the front side sealing portion 66 of the measurement shutter member 33 is abutted with the outer peripheral surface 39 of the inner lid 32, both the arc side surface portions 65, 65 are abutted with the inner discharge port sealing member 34A, and the rear side opened portion 67 is abutted with the inner discharge port sealing member 34B, the measurement shutter member 33 forms predetermined space 69 between the measurement shutter member 33 and the inner discharge port 40 so as to seal the inner discharge port 40. That is, at the accumulation position where the outer peripheral edge 68 of the measurement shutter member 33 seals the outer peripheral surface 39 of the inner lid 32, a fixed amount of the toner can be accumulated in the space 69. The measurement shutter member 33 is fixed to the fixing portion 41 of the inner lid 32 and provided so as to cover the inner discharge port 40. That is, the measurement shutter member 33 is attached to the inner lid 32 so that apart on the front side of the inner discharge port 40 in the forward direction in rotation of the toner bottle main body 19*a* serves as a fixed end, and apart on the rear side serves as a free end. The fixed end is formed by inserting the shaft 63 of the fixing portion 41 into U shape parts of rotation support portions 64 provided so that the U shape parts are positioned on the outer side in the radial direction relative to the rotation shaft. The shaft 63 may be integrally provided in the inner lid 32 and bosses may be provided in the inner lid 32 so that the shaft 63 is inserted into the bosses. The measurement shutter member 33 is movable between the accumulation position where the toner is accumulated in the space 69 and a discharge position where at least part of the outer peripheral edge 68 is brought away from the outer peripheral surface 39 of the inner lid 32, so that the toner accumulated in the space 69 is discharged from the rear side opened portion 67.

The inner discharge port sealing members 34 include the inner discharge port sealing member 34A and the inner discharge port sealing member 34B.

The inner discharge port sealing member 34A is provided with a base portion 71 and elastic side edge portions 72. The base portion 71 is formed by processing a rectangular thin plate into a shape with which the longitudinal direction corresponds to the circumferential direction of the outer peripheral surface 39 of the inner lid 32. The base portion 71 is formed into an arc shape in a section orthogonal to the rotation shaft. On the side of the fixing portion 41 of the base portion 71, cutouts 73, 73 for avoiding interference with the bosses 70 on the outer peripheral surface 39 of the inner lid 32 are provided so as to be fixed between the bosses 70, 70 of the inner lid 32. The inner discharge port sealing member 34A is provided with a hole 62 arranged concentrically to the inner discharge port 40 of the inner lid 32. The elastic side edge portions 72 are formed by elastic bodies and provided on both side edges of the base portion 71 in parallel to the forward direction in the rotation while keeping away from parts interfering with the bosses 70 of the inner lid 32. The hole 62 is positioned between the elastic side edge portions 72, 72. The elastic side edge portions 72 are formed into a rectangular shape in a section orthogonal to the forward direction in the rotation. End surfaces of the elastic side edge portions 72 on the side of the cutouts 73, 73 are abutted with the front side sealing portion 66 at the accumulation position of the measurement shutter member 33 so as to seal the inner discharge port 40.

The inner discharge port sealing member 34B is an elastic body provided in the inner lid 32 so as to be abutted with the rear side opened portion 67 on an inner surface of the measurement shutter member 33 at the accumulation position. The inner discharge port sealing member 34B is abutted with ends of the elastic side edge portions 72 on the opposite side of the cutouts 73, 73. The inner discharge port sealing member 34B seals the rear side opened portion 67 of the measurement shutter member 33 at the accumulation position. Protrusion length of the inner discharge port sealing member 34B in the radial direction from the inner lid 32 may be the same as protrusion length of the inner discharge port sealing member 34A in the radial direction from the inner lid 32 or may be longer than the protrusion length of the inner discharge port sealing member 34A. The inner discharge port sealing member 34B and the rear side opened portion 67 of the measurement shutter member 33 at the accumulation position may be abutted with each other on an end surface of the measurement shutter member 33.

The inner discharge port sealing members 34 are provided in circumference of the inner discharge port 40. The inner discharge port sealing members 34 seal the inner discharge port 40 at the accumulation position of the measurement shutter member 33 between the inner lid 32 and the measurement shutter member 33. In the present embodiment, the inner discharge port sealing members 34 are divided as the inner discharge port sealing member 34A and the inner discharge port sealing member 34B but may be integrally formed. Further, the inner discharge port sealing member 34B may be attached on the front and rear sides in the forward direction in the rotation in accordance with volume required for the space 69 of the measurement shutter member 33.

Figure 6:
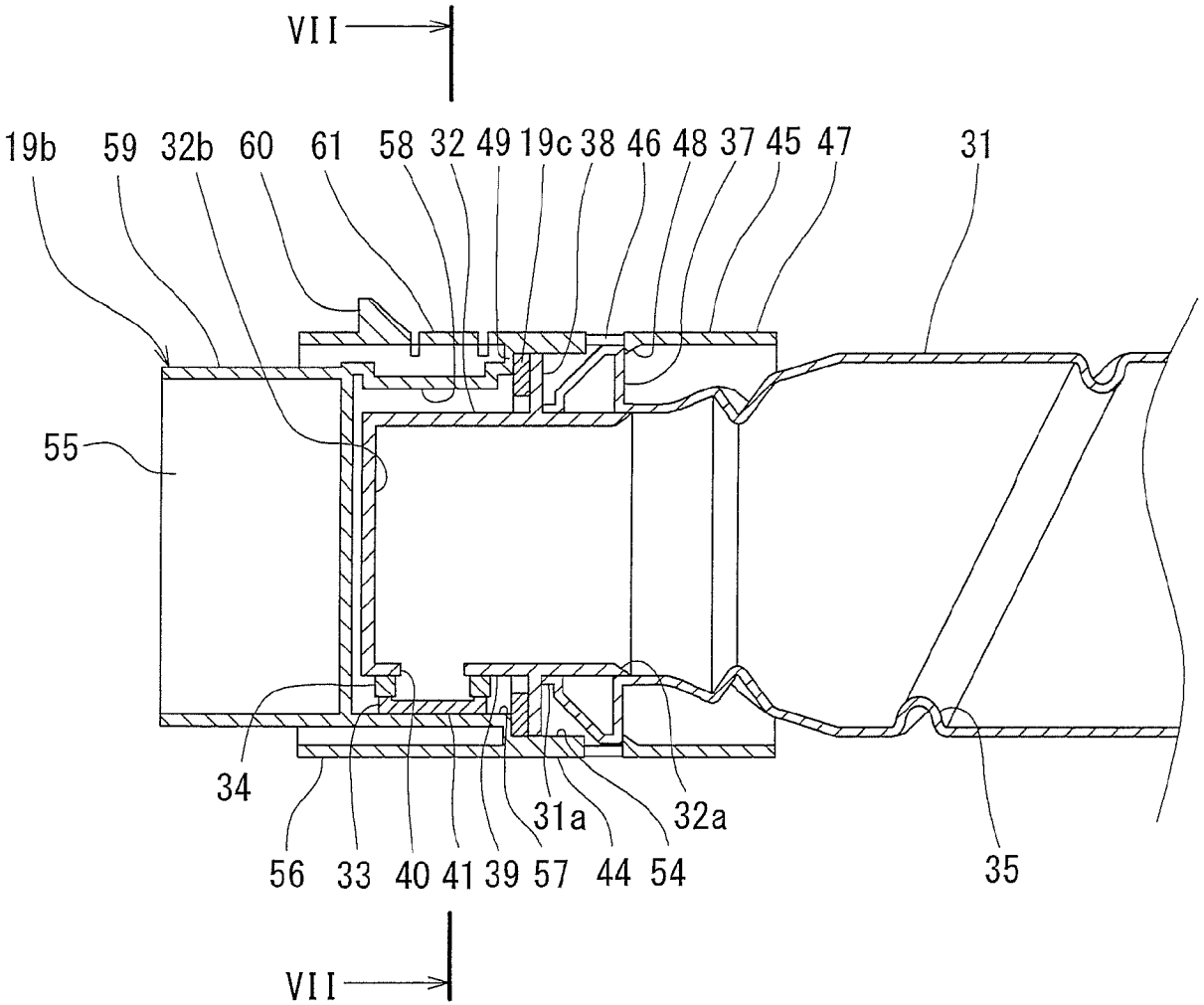
FIG. 6 is a partially enlarged view of the toner bottle according to the present invention.
Figure 7:
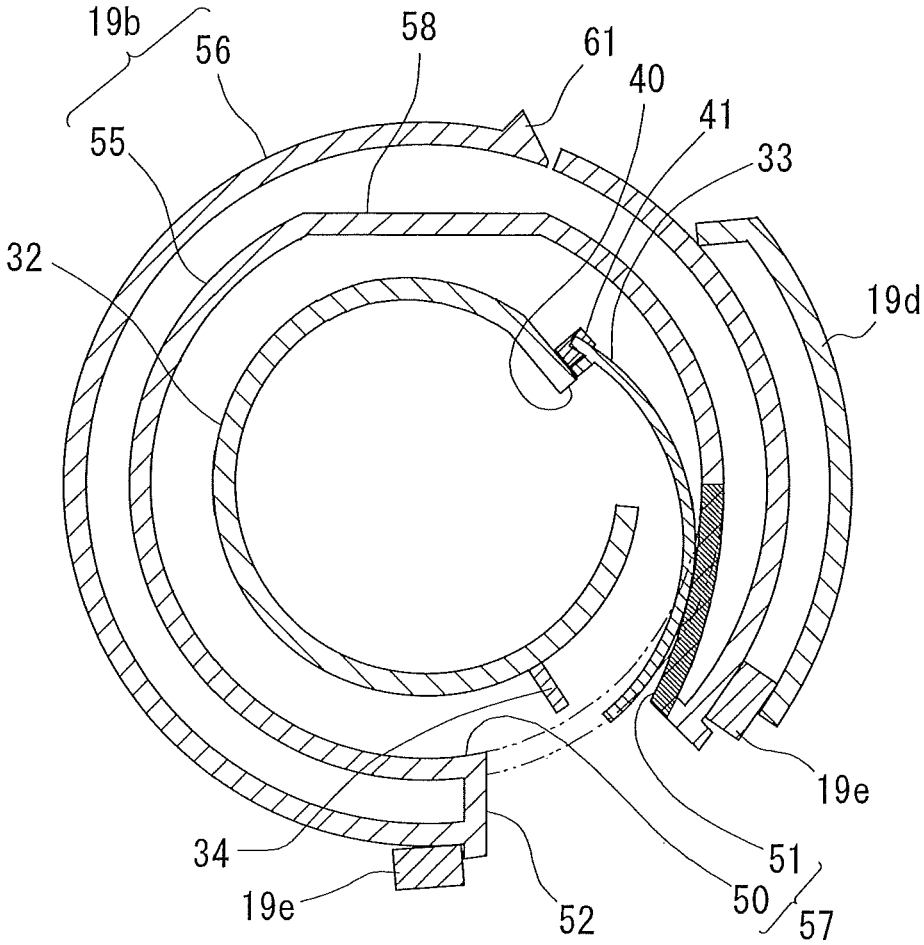
FIG. 7 is a sectional view of the toner bottle by line VII-VII.
Figure 9A:
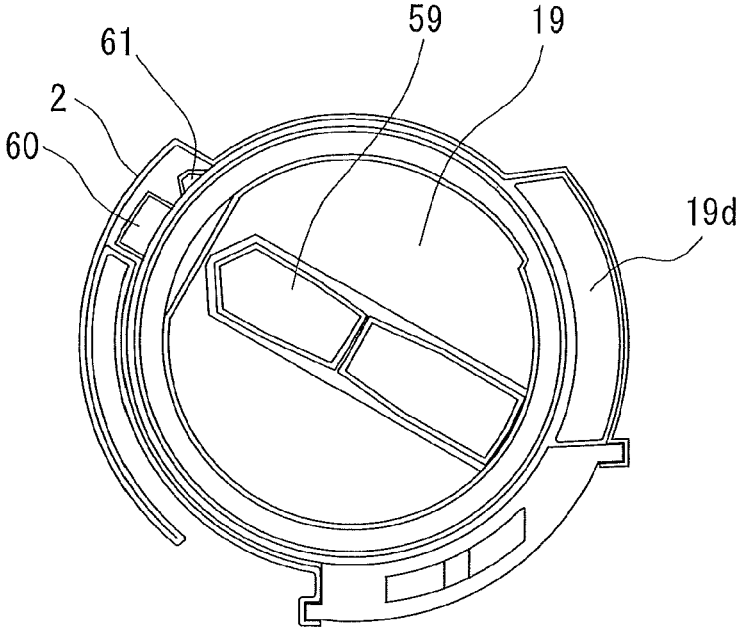
FIG. 9A is a view showing an insertion position of the toner bottle.

As shown in FIG. 6, the outer lid 19*b* is formed into a cylindrical shape having a closed portion on the one side and an opened portion on the other side. On an outer peripheral surface 44 of the outer lid 19*b*, a plurality of rotation support engagement portions 45 is provided so as to be spaced from each other by a predetermined amount. The rotation support engagement portions 45 are protrusions 47 formed on the outer peripheral surface 44 on the inner side of a cutout 46 provided in the outer peripheral surface 44 so as to continuously extend from the side of an opened portion 74. Claws 48 extending inward in the radial direction are provided in ends of the protrusions 47. In the outer lid 19*b*, the inner lid 32 of the toner bottle main body 19*a* is inserted into an interior from the opened portion 74, and the rotation support engagement portion 37 of the toner accommodating container 31 is engaged with the rotation support engagement portion 45 of the outer lid 19*b*. The outer lid 19*b* rotatably supports the toner bottle main body 19*a* in a state that the outer lid 19*b* surrounds the inner discharge port 40 of the inner lid 32. The outer lid 19*b* is installed in the main body 2 of the image formation apparatus rotatably between an insertion position (FIG. 9A) to be inserted from a front surface in the main body 2 of the image formation apparatus, and a predetermined installation position (FIG. 9B) to be rotated and installed from the insertion position. When the outer lid 19*b* is installed at the predetermined installation position, a narrow portion 58 described later is parallel to a horizontal plane. In FIG. 7, an outer discharge port 52 described later is arranged in a range from the lower side in the substantially vertical direction to the front side of a substantially horizontal position in the anti-clockwise direction.

An intermediate inner peripheral surface 54 is formed in the outer lid 19*b* on the opposite side of the opening relative to the cutout 46. A flange receiving portion 49 protruding inward in the radial direction from the intermediate inner peripheral surface 54 is provided in an end of the intermediate inner peripheral surface 54 on the opposite side of the cutout 46. The flange receiving portion 49 is abutted with the flange portion 38 of the toner bottle main body 19*a* slidably via the shaft direction sealing member 19*c* in a state that the rotation support engagement portion 37 of the toner accommodating container 31 is engaged with the rotation support engagement portion 45 of the outer lid 19*b*.

Figure 8:
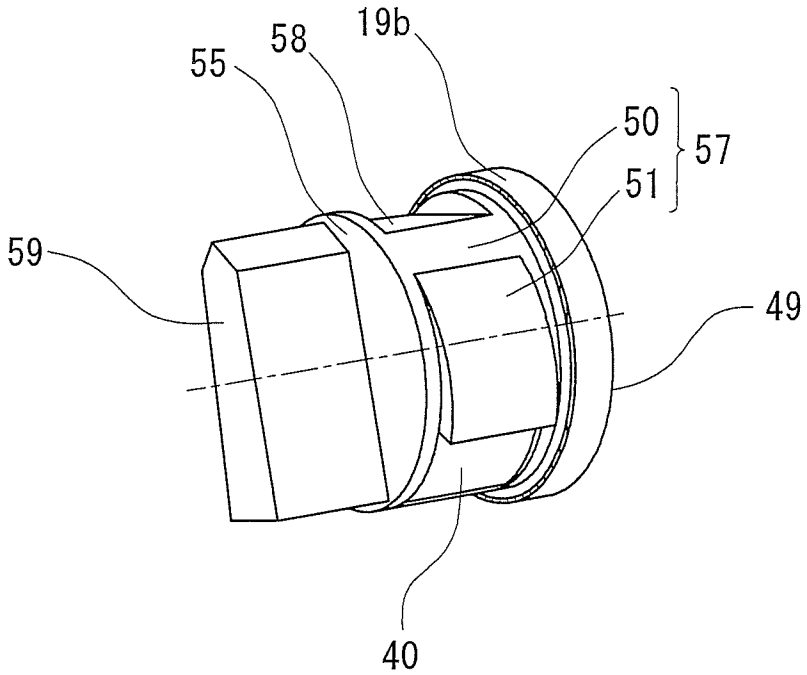
FIG. 8 is a view showing an inner cylinder portion of an outer lid.

An end of the flange receiving portion 49 on the inner side in the radial direction is arranged coaxially to the rotation shaft of the outer lid 19*b* and connected to the opening side of an inner cylinder portion 55 having a closed portion on the one side and an opened portion on the other side. As shown in FIG. 7, part of the outer lid 19*b* has a double structure in which the inner cylinder portion 55 is provided inside an outer cylinder portion 56. On an inner peripheral surface of the inner cylinder portion 55 in parallel to the rotation shaft, a shutter opening and closing inner peripheral surface 57 is formed. On the shutter opening and closing inner peripheral surface 57, a restraint portion 50 to be abutted with the outer surface 42 of the measurement shutter member 33 for restraining the measurement shutter member 33 at the accumulation position, and a non-restraint portion 51 capable of moving the measurement shutter member 33 to the discharge position so that the outer surface 42 of the measurement shutter member 33 is abutted with the non-restraint portion are arranged in the circumferential direction via the outer discharge port 52. The restraint portion 50 is provided in a range from the lower side in the substantially vertical direction to a substantially horizontal position in the clockwise rotation direction exceeding the upper side in the substantially vertical direction on a line formed by a perfect circle about an axis of the rotation shaft. The non-restraint portion 51 is provided between the substantially horizontal position and the outer discharge port 52 on a line formed by part of an oval coming off outward in the radial direction from the perfect circle forming the restraint portion 50 (the part shown by crosshatching in FIG. 7). In other words, at a position where a center of the inner discharge port 40 of the inner lid 32 passes through a substantially horizontal plane including the rotation shaft, the measurement shutter member 33 is to be abutted with an end of the restraint portion 50 (a terminal end of the restraint portion 50 in the rotation) on the lower side in the substantially vertical direction. On the shutter opening and closing inner peripheral surface 57, the narrow portion 58 formed by a substantially flat surface having a shorter distance from the center of the rotation shaft to the restraint portion 50 is provided in a range of the restraint portion 50 positioned on the substantially opposite side of the inner discharge port 40. As shown in FIG. 8, on a closed surface of the inner cylinder portion 55 in parallel to the flange receiving portion 49, a narrow position display portion 59 capable of visually recognizing a position of the narrow portion 58 from the exterior is provided so as to extend on the opposite side of the opening. The narrow position display portion 59 is formed into a plate shape having one pointed end in the longitudinal direction in a section orthogonal to the rotation shaft, and the other flat end. The pointed part of the narrow position display portion 59 is arranged in the same direction as the narrow portion 58 relative to the center of the rotation shaft. A plane on which the narrow portion 58 is formed is orthogonal to a plane passing through the pointed part and including the rotation shaft. The narrow position display portion 59 also plays a role of an operation unit for rotating the toner bottle 19 about the axis of the rotation shaft.

Figure 9B:
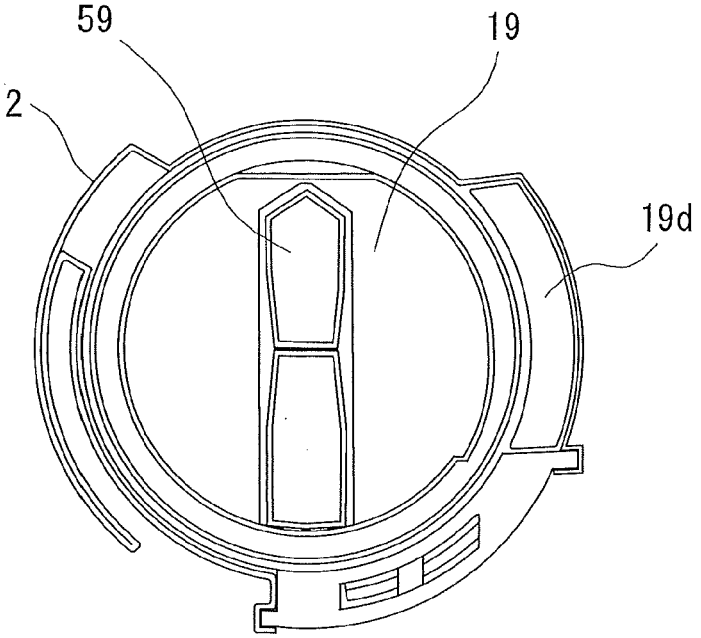
FIG. 9B is a view showing an installation position of the toner bottle.

The outer discharge port 52 of the outer lid 19*b* passes through the outer peripheral surface 44 at the same position as the inner discharge port 40 in the rotation shaft direction, and the shutter opening and closing inner peripheral surface 57. On the both sides in the shaft direction of the outer discharge port 52, a guide rail portion 53 for guiding movement of the outer shutter member 19*d* in the circumferential direction is provided. The guide rail portion 53 protrudes outward in the radial direction from the outer peripheral surface 44 of the outer lid 19*b*. In the outer lid 19*b*, a circumferential direction stopper portion 60 protruding outward in the radial direction is provided on the outer peripheral surface 44 in the same direction as the pointed part of the narrow position display portion 59 relative to the rotation shaft. With the circumferential direction stopper portion 60, the toner bottle 19 inserted into the front surface in the main body 2 of the image formation apparatus in the orthogonal direction is rotated in the clockwise direction seen from the front so as to be positioned at the predetermined installation position (FIG. 9B). On the outer peripheral surface 44 on the side of the toner bottle main body 19*a* relative to the circumferential direction stopper portion 60, a circumferential direction locking portion 61 is provided. With the circumferential direction locking portion 61, the toner bottle 19 is locked on the main body 2 of the image formation apparatus at the predetermined installation position (FIG. 9B).

The shaft direction sealing member 19*c* is arranged so as to be abutted with both the flange portion 38 of the toner bottle main body 19*a* and the flange receiving portion 49 of the outer lid 19*b*, in a state that the rotation support engagement portion 37 of the toner accommodating container 31 is engaged with the rotation support engagement portion 45 of the outer lid 19*b*. The inner lid 32 is attached to the outer lid 19*b* slidably so as to have the sealing property.

The outer shutter member 19*d* is formed into an arc shape in a section orthogonal to the rotation shaft and bent inward by 90 degrees at side edges of the arc shape parts so as to extend inward in the radial direction and nip the guide rail portion 53. The outer shutter member 19*d* is movable on the guide rail portion 53 between a close position where the outer discharge port 52 is closed and communication between an interior and an exterior of the outer lid 19*b* is blocked, and an open position where the outer discharge port 52 is opened and the interior and the exterior of the outer lid 19*b* communicate with each other. After the toner bottle 19 is inserted into the main body 2 of the image formation apparatus and then the toner bottle 19 is rotated to the predetermined installation position (FIG. 9B), only the outer shutter member 19*d* is to be engaged with an outer shutter engagement portion (not shown) in the main body 2 of the image formation apparatus and fixed at a position where the outer discharge port 52 of the toner bottle 19 is opened at the predetermined installation position (FIG. 9B). The outer discharge port 52 is connected to the toner feed device 29, and the engagement portion 36 of the toner bottle main body 19*a* and the drive unit 2*b* in the main body 2 of the image formation apparatus are engaged with each other, so that the drive force from the drive unit 2*b* is transmitted to the toner bottle main body 19*a* by a signal from the control unit 2*a*.

The outer discharge port sealing member 19*e* is provided in a circumferential edge of the outer discharge port 52. The outer discharge port sealing member 19*e* is an elastic body. The outer discharge port sealing member 19*e* seals the outer discharge port 52 between the outer lid 19*b* and the outer shutter member 19*d* at the close position of the outer shutter member 19*d*.

Operations of the toner bottle 19 with the above configuration will be described.

When the TCR sensor 14*c* for measuring concentration of a developer in the developing device 14 detects a decrease in the concentration of the developer, the drive unit 2*b* is started up by the signal from the control unit 2*a*, so that the toner bottle main body 19*a* is rotated. It should be noted that in a case where the TCR sensor, 14*c* detects the decrease in the concentration of the developer in the developing device 14 for a number of times, the control unit 2*a* sends the signal to an operation panel (not shown) or the like in the main body 2 of the image formation apparatus, so that a caution is given to a user.

Figure 10:
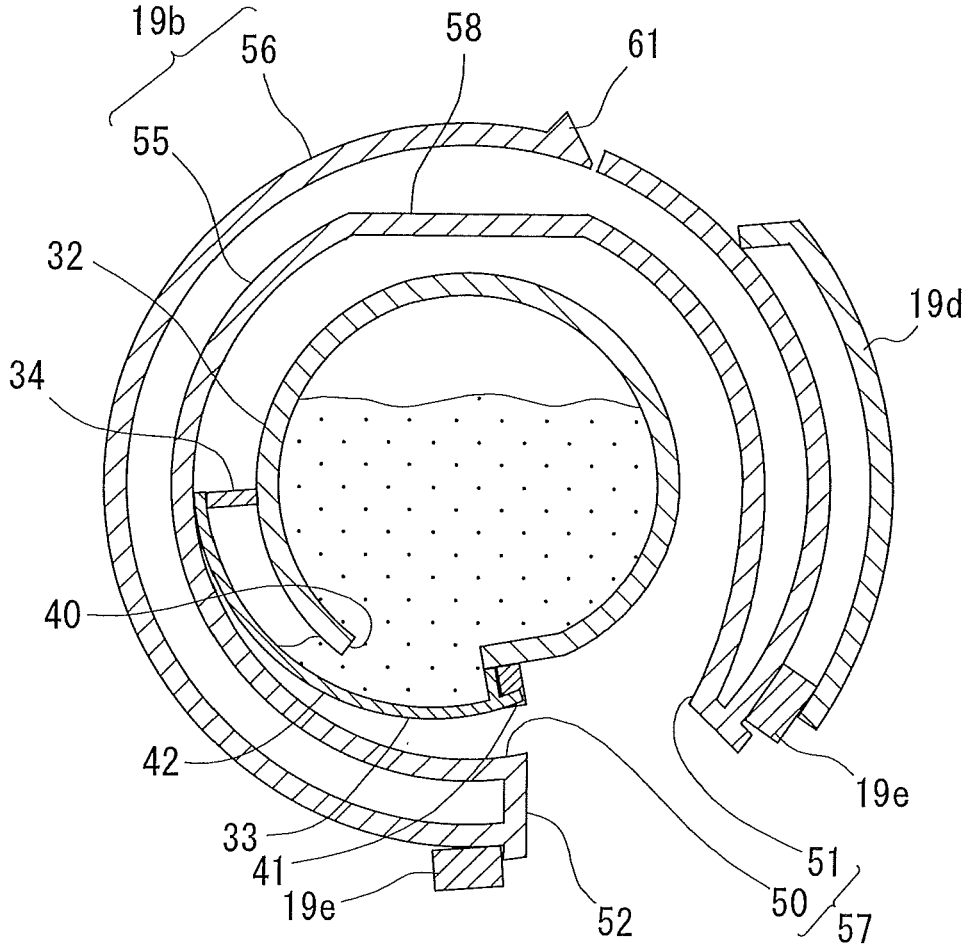
FIG. 10 is a view showing an interior of the toner bottle.

As shown in FIG. 10, in an area of the restraint portion 50 on the front side of the narrow portion 58 in the forward direction in the rotation, the inner lid 32 is rotated in a state that the outer surface 42 of the measurement shutter member 33 is abutted with the shutter opening and closing inner peripheral surface 57 and the measurement shutter member 33 is sealed by the inner discharge port sealing member 34. When the inner discharge port 40 of the inner lid 32 is moved from the side of the narrow portion 58 close to the lower side in the vertical direction, the toner fed from the toner accommodating container 31 of the toner bottle main body 19*a* to the toner feed portion 35 is discharged from the inner discharge port 40 of the inner lid 32 so as to come into the space 69 of the measurement shutter member 33.

Figure 11:
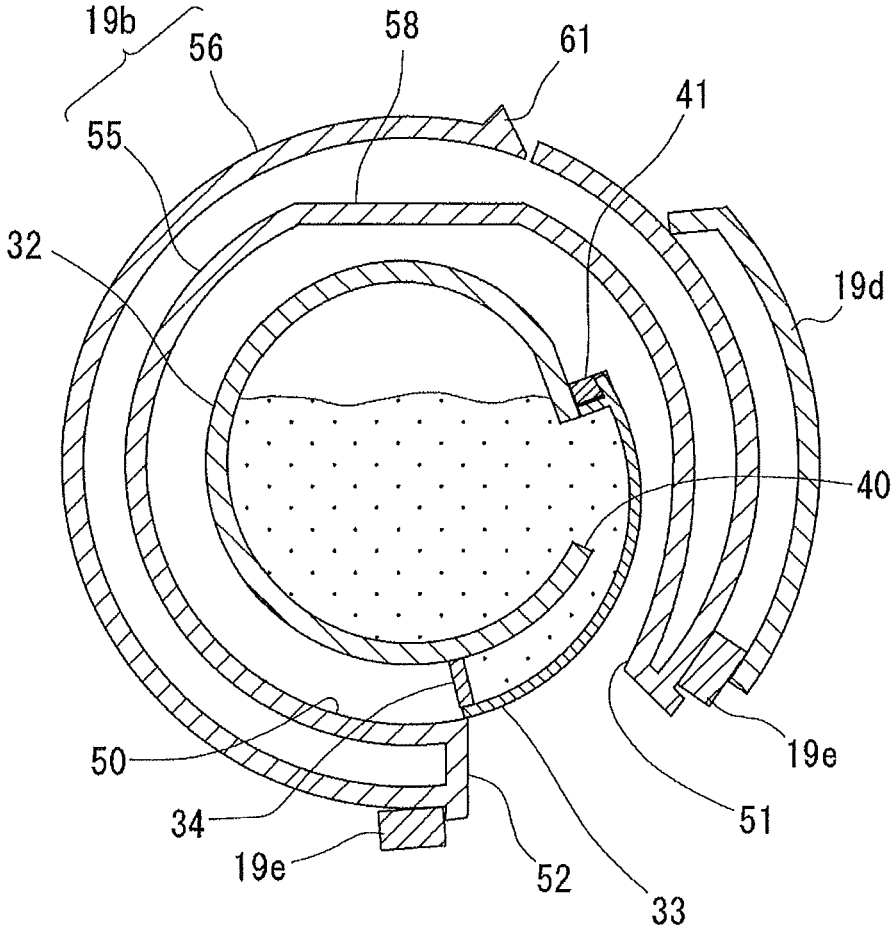
FIG. 11 is a view showing the interior of the toner bottle.

As shown in FIG. 11, as long as the end of the restraint portion 50 on the front side of the narrow portion 58 in the forward direction in the rotation is abutted with the measurement shutter member 33, the measurement shutter member 33 is maintained to accumulate the toner. A state that an end of the measurement shutter member 33 is abutted with the end of the restraint portion 50 indicates immediately before the center of the inner discharge port 40 of the inner lid 32 comes onto a substantially horizontal plane passing through the rotation shaft of the toner bottle 19. Therefore, the toner fed through the inner discharge port 40 passing through the lower side in the vertical direction up to the substantially horizontal position can sufficiently come into the space 69 of the measurement shutter member 33 so as to be charged. In such a way, the measurement shutter member 33 at the accumulation position blocks communication between an interior of the toner accommodating container 31 and an exterior of the measurement shutter member 33, so that a fixed amount of the toner can be accommodated in the space 69 of the measurement shutter member 33.

Figure 12:
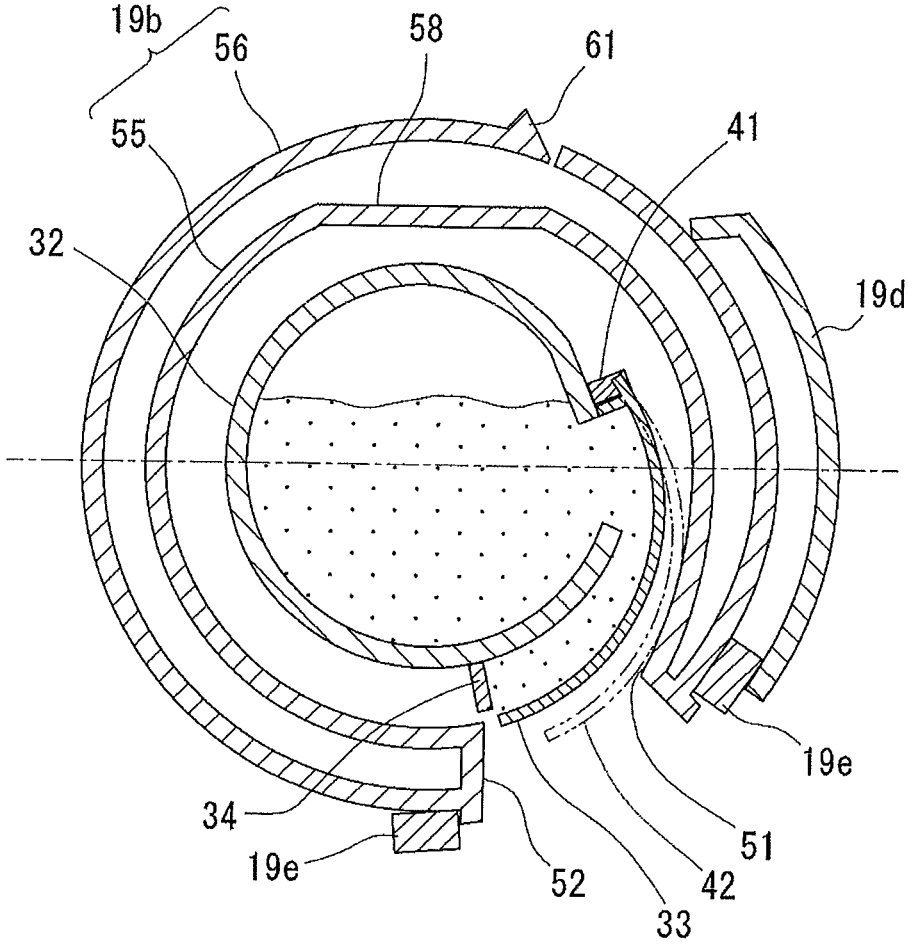
FIG. 12 is a view showing the interior of the toner bottle.

As shown in FIG. 12, when the end of the measurement shutter member 33 passes through the area of the restraint portion 50, that is, when the center of the inner discharge port 40 of the inner lid 32 passes through on the substantially horizontal plane passing through the rotation shaft of the toner bottle 19, the measurement shutter member 33 cannot be restrained at the accumulation position. As a result, by weight of the toner charged inside the measurement shutter member 33 and reactive force of the elastic body of the inner discharge port sealing member 34, the outer peripheral edge 68 of the measurement shutter member 33 is brought away from the outer peripheral surface 39 of the inner lid 32 relative to the fixing portion 41, and moved to the discharge position of the measurement shutter member 33. The outer surface 42 of the measurement shutter member 33 is abutted with the non-restraint portion 51 of the shutter opening and closing inner peripheral surface 57.

Figure 13:
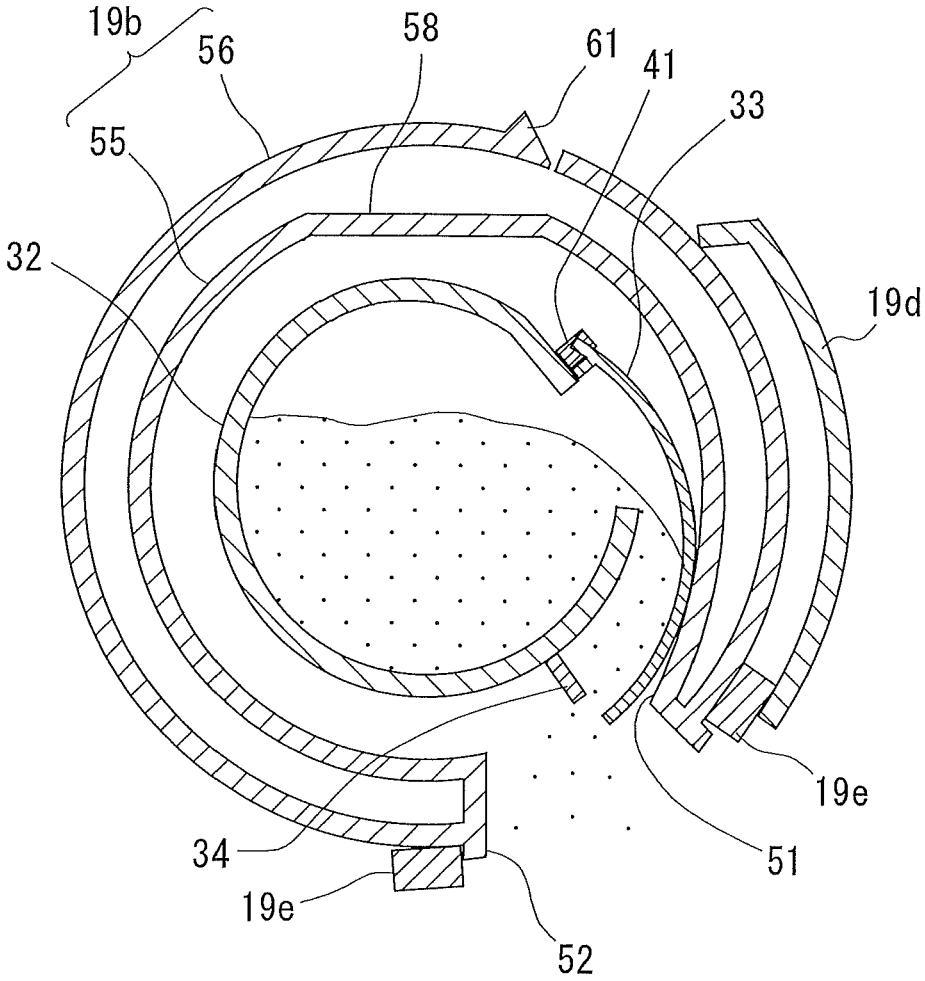
FIG. 13 is a view showing the interior of the toner bottle.

As shown in FIG. 13, in a state that the measurement shutter member 33 is abutted with the non-restraint portion 51, the rear side opened portion 67 of the measurement shutter member 33 is opened. Thus, all the toner charged in the space 69 of the measurement shutter member 33 is dropped through the rear side opened portion 67. The dropped toner is sent to the toner feed device 29 through the outer discharge port 52. As described above, when the measurement shutter member 33 is moved to the discharge position, the interior of the toner accommodating container 31 and the exterior of the measurement shutter member 33 communicate with each other. Thus, a fixed amount of the toner accommodated in the space 69 of the measurement shutter member 33 can be discharged to the exterior. That is, a fixed amount of the toner can be supplied from the inner discharge port 40 of the toner bottle 19. Since the toner bottle main body 19*a* and the measurement shutter member 33 are integrally formed, the toner bottle 19 capable of supplying a fixed amount of the toner can be made a compact and low-cost structure.

Figure 14:
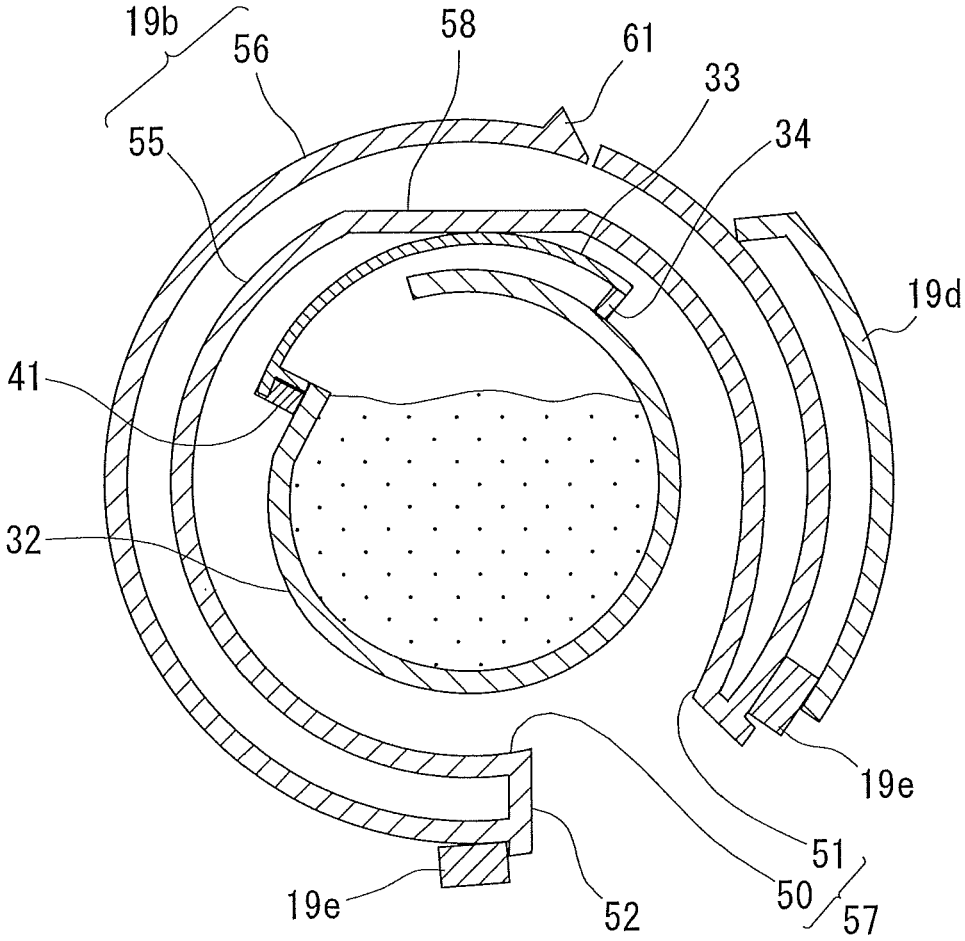
FIG. 14 is a view showing the interior of the toner bottle.

As shown in FIG. 14, when the measurement shutter member 33 is moved to the area of the narrow portion 58, the distance from the center of the rotation shaft to the narrow portion 58 is shorter than the distance to the restraint portion 50. Thus, the measurement shutter member 33 receives further stronger force from the narrow portion 58 than the other restraint portion 50 excluding the narrow portion 58, so that the inner discharge port sealing member 34 is elastically deformed. Therefore, the measurement shutter member 33 is moved to the side of the center of the rotation shaft. In such a way, the outer surface 42 of the measurement shutter member 33 can be pressed by the narrow portion 58 with stronger force than the other restraint portion 50 excluding the narrow portion 58, so that the inner discharge port 40 can be reliably closed.

After the measurement shutter member 33 passes through the area of the narrow portion 58 and then the toner bottle main body 19*a* is rotated, a state is again as shown in FIG. 10. As described above, since the restraint portion 50 and the non-restraint portion 51 are arranged in the circumferential direction on the shutter opening and closing inner peripheral surface 57, the toner bottle main body 19*a* is rotated, so that the measurement shutter member 33 can be periodically moved between the accumulation position and the discharge position. A fixed amount of the toner accommodated in the space 69 of the measurement shutter member 33 can be discharged to the exterior. That is, a fixed amount of the toner can be supplied from the inner discharge port 40 of the toner bottle 19.

In the toner bottle 19, since positions of the measurement shutter member 33 and the narrow portion 58 are aligned in the rotation circumferential direction of the toner accommodating container 31, toner leakage of the toner bottle 19 before installed to the main body 2 of the image formation apparatus can be effectively prevented.

Figure 15A:
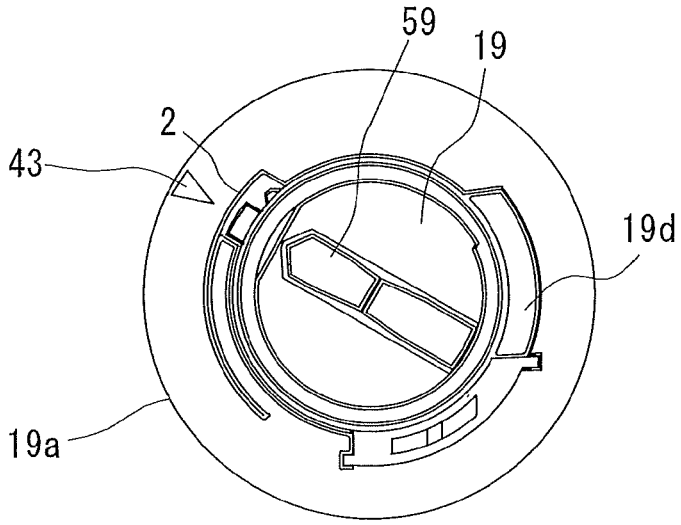
FIG. 15A is a view showing a state that the toner bottle is first inserted into a main body of the image formation apparatus.

FIG. 15A shows a state that the toner bottle 19 is first inserted into the main body 2 of the image formation apparatus. In the toner bottle 19 in an initial state, the pointed part of the narrow position display portion 59 and the measurement shutter position display portion 43 are respectively positioned in the same direction on the outer side in the radial direction of the center of the rotation shaft. That is, the narrow portion 58 is abutted with the measurement shutter member 33. The outer surface of the measurement shutter member 33 can be pressed by the narrow portion 58 with stronger force than the other restraint portion 50 excluding the narrow portion 58, so that the inner discharge port 40 can be reliably closed. Therefore, in a case where the toner bottle 19 is transported, or in a case where the toner bottle 19 is shaken in order to improve liquidity of the toner before installed to the main body 2 of the image formation apparatus, the toner leakage can be prevented.

Figure 15B:
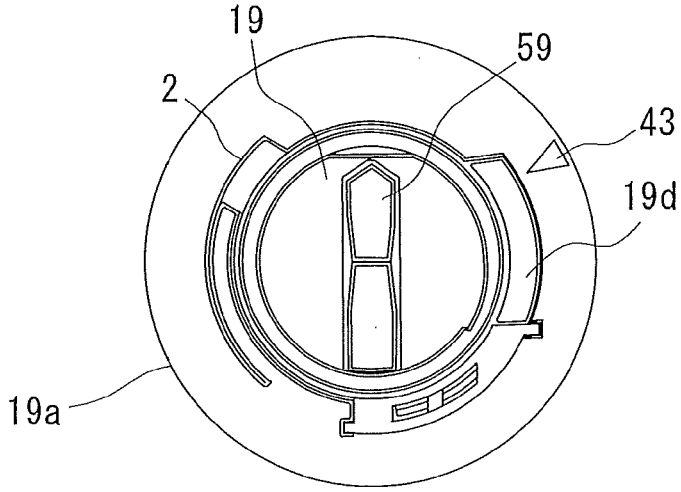
FIG. 15B is a view showing a state after the toner bottle inserted into the main body of the image formation apparatus is rotated from the insertion position to the installation position, and then use is started.

FIG. 15B shows a state after the toner bottle 19 inserted into the main body 2 of the image formation apparatus is rotated from the insertion position to the installation position, and then use is started. At this time, the pointed part of the narrow position display portion 59 is positioned on the upper side in the vertical direction relative to the center of the rotation shaft. As the inner lid 32 is rotated together with the toner accommodating container 31 for supplying the toner after the start of the use, the measurement shutter position display portion 43 is moved to a position corresponding to the measurement shutter member 33.

Although the present invention has been fully described by way of the examples with reference to the accompanying drawings, it is to be noted that various changes and modifications will be apparent to those skilled in the art. Therefore, unless such changes and modifications otherwise depart from the scope of the present invention, they should be construed as being included therein.

What is claimed is:

1. A toner bottle, comprising:

a cylindrical toner accommodating container having an opened portion on the one side and a closed portion on the other side for accommodating toner inside;

an inner lid attached to the toner accommodating container so as to close the opened portion, the inner lid including an inner discharge port on an outer peripheral surface;

a measurement shutter member provided so as to cover the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged; and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion;

wherein the measurement shutter member is moved from the accumulation position to the discharge position so that the measurement shutter member is abutted with the non-restraint portion when a center of the inner discharge port of the inner lid passes through a substantially horizontal plane including a rotation shaft.

2. The toner bottle according to claim 1, further comprising:

an inner discharge port sealing member provided in circumference of the inner discharge port for sealing the inner discharge port at the accumulation position of the measurement shutter member between the inner lid and the measurement shutter member.

3. The toner bottle according to claim 1, wherein the measurement shutter member is attached to the inner lid so that a part on the front side of the inner discharge port in the forward direction in rotation of the inner lid serves as a fixed end, and a part on the rear side serves as a free end.

4. A toner bottle comprising:

a cylindrical toner accommodating container having an opened portion on the one side and a closed portion on the other side for accommodating toner inside;

an inner lid attached to the toner accommodating container so as to close the opened portion, the inner lid including an inner discharge port on an outer peripheral surface;

a measurement shutter member provided so as to cover the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged; and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion;

wherein the outer lid includes a narrow portion having a shorter distance from a center of a rotation shaft to the restraint portion, and a narrow position display portion capable of visually recognizing a position of the narrow portion from an exterior.

5. A toner bottle comprising:

a cylindrical toner accommodating container having an opened portion on the one side and a closed portion on the other side for accommodating toner inside;

an inner lid attached to the toner accommodating container so as to close the opened portion, the inner lid including an inner discharge port on an outer peripheral surface;

a measurement shutter member provided so as to cover the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged; and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion;

wherein the toner accommodating container includes a measurement shutter position display portion capable of visually recognizing a position of the measurement shutter member from an exterior.

6. An image formation apparatus, comprising:

a toner bottle, having:

a cylindrical toner accommodating container having an opened portion on the one side and a closed portion on the other side for accommodating toner inside;

an inner lid attached to the toner accommodating container so as to close the opened portion, the inner lid including an inner discharge port on an outer peripheral surface;

a measurement shutter member covered over the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged; and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion;

wherein the measurement shutter member of the toner bottle is moved from the accumulation position to the discharge position so that the measurement shutter member is abutted with the non-restraint portion when a center of the inner discharge port of the inner lid passes through a substantially horizontal plane including a rotation shaft.

7. The image formation apparatus according to claim 6, wherein the toner bottle further comprises an inner discharge port sealing member provided in circumference of the inner discharge port for sealing the inner discharge port at the accumulation position of the measurement shutter member between the inner lid and the measurement shutter member.

8. The image formation apparatus according to claim 6, wherein the measurement shutter member of the toner bottle is attached to the inner lid so that a part on the front side of the inner discharge port in the forward direction in rotation of the inner lid serves as a fixed end, and a part on the rear side serves as a free end.

9. An image formation apparatus comprising:

a toner bottle, having:

a cylindrical toner accommodating container having an opened portion on the one side and a closed portion on the other side for accommodating toner inside;

an inner lid attached to the toner accommodating container so as to close the opened portion, the inner lid including an inner discharge port on an outer peripheral surface;

a measurement shutter member covered over the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged; and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion;

wherein the outer lid of the toner bottle includes a narrow portion having a shorter distance from a center of a rotation shaft to the restraint portion, and a narrow position display portion capable of visually recognizing a position of the narrow portion from an exterior.

10. An image formation apparatus comprising:

a toner bottle, having:

a cylindrical toner accommodating container having an opened portion on the one side and a closed portion on the other side for accommodating toner inside;

an inner lid attached to the toner accommodating container so as to close the opened portion, the inner lid including an inner discharge port on an outer peripheral surface;

a measurement shutter member covered over the inner discharge port of the inner lid from the outer side, the measurement shutter member being movable between an accumulation position where predetermined space is formed between the measurement shutter member and the inner discharge port with an outer peripheral edge sealing the outer peripheral surface of the inner lid, so that the toner is accumulated in the space, and a discharge position where at least part of the outer peripheral edge is brought away from the outer peripheral surface of the inner lid, so that the toner accumulated in the space is discharged; and an outer lid for rotatably supporting the toner accommodating container in a state that the outer lid surrounds the inner discharge port of the inner lid, the outer lid having a shutter opening and closing inner peripheral surface where a restraint portion to be abutted with an outer surface of the measurement shutter member for restraining the measurement shutter member at the accumulation position, and a non-restraint portion capable of moving the measurement shutter member to the discharge position so that the outer surface of the measurement shutter member is abutted with the non-restraint portion are arranged in the circumferential direction, the outer lid including an outer discharge port communicating with the space of the measurement shutter member when the measurement shutter member is moved to the discharge position where the measurement shutter member is abutted with the non-restraint portion;

wherein the toner accommodating container of the toner bottle includes a measurement shutter position display portion capable of visually recognizing a position of the measurement shutter member from an exterior.

* * * * *